US006877348B2

(12) United States Patent
Buecker et al.

(10) Patent No.: US 6,877,348 B2
(45) Date of Patent: Apr. 12, 2005

(54) CLOSING DEVICE FOR A VEHICLE

(75) Inventors: Rolf Buecker, Coburg (DE); Joerg Uebelein, Grub am Forst (DE); Uwe Sommer, Effelder (DE); Andre Goertz, Dresden (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 88 days.

(21) Appl. No.: 10/380,391

(22) PCT Filed: Sep. 4, 2001

(86) PCT No.: PCT/DE01/03436

§ 371 (c)(1),
(2), (4) Date: Mar. 11, 2003

(87) PCT Pub. No.: WO02/22999

PCT Pub. Date: Mar. 21, 2002

(65) Prior Publication Data

US 2003/0196465 A1 Oct. 23, 2003

(51) Int. Cl.[7] ..... E05B 53/00; E05B 63/14; E05B 65/36

(52) U.S. Cl. ..... 70/264; 292/201; 70/262

(58) Field of Search ..... 70/262, 263, 264, 70/256; 292/DIG. 26, DIG. 27, 201

(56) References Cited

U.S. PATENT DOCUMENTS 5,603,537 A * 2/1997 Amano et al. ..... 292/201
5,621,251 A * 4/1997 Yamazaki ..... 307/10.2
5,667,260 A * 9/1997 Weyerstall ..... 292/201
6,062,613 A * 5/2000 Jung et al. ..... 292/201
6,304,003 B1 10/2001 Rathmann et al.
6,526,790 B2 * 3/2003 Wegner ..... 70/277

FOREIGN PATENT DOCUMENTS

| | | |
|---|---|---|
| DE | 41 31 891 A1 | 4/1993 |
| DE | 196 31 869 A1 | 2/1998 |
| DE | 197 55 207 A1 | 6/1998 |
| DE | 199 17 789 A1 | 12/1999 |
| DE | 198 41 670 A1 | 3/2000 |
| DE | 100 01 435 A1 | 5/2001 |
| WO | WO 97/43510 | 11/1997 |

OTHER PUBLICATIONS

International Search Report of PCT/DE01/03436, dated Feb. 1, 2002.

International Preliminary Examination Report of PCT/DE01/03436, dated Sep. 6, 2002.

* cited by examiner

*Primary Examiner*—John B. Walsh
(74) *Attorney, Agent, or Firm*—Christie, Parker and Hale, LLP

(57) ABSTRACT

The invention relates to a closing device for a vehicle comprising a lock, a drive for determining the locking state of the locking device, by means of which the locking device may be placed in at least four different locking states and a rotating shaped disc on the drive, which may be rotated by the drive to determine the individual locking states, whereby the individual locking states are each assigned a particular angular position for the shaped disc. According to the invention, the shaped disc (1) is of such a form that said disc may be taken from each angular position, corresponding to one of the various states (V, K, S) and different to the unlocked state (E), without a third locking state occurring on performing the above.

26 Claims, 5 Drawing Sheets

CLOSING DEVICE FOR A VEHICLE

CROSS-REFERENCE TO RELATED APPLICATION

This application is a National Phase Patent Application of International Application Number PCT/DE01/03436, filed on Sep. 4, 2001, which claims priority of German Patent Application Number 100 46 188.3, filed Sep. 12, 2000.

FIELD OF THE INVENTION

The invention relates to a closing device for a vehicle.

BACKGROUND OF THE INVENTION

A closing device for a vehicle may include at least one lock; a drive for determining the locking states of the closing device (i.e. the locking states of the lock or locks), and through which the closing device can be brought into multiple different locking states such as the unlocked, locked, dead-lock and child-lock states; and a rotary mounted shaped disc on the drive which can be rotated by the drive to determine the individual locking states, whereby the different locking states are each assigned specific angular positions of the shaped disc.

A closing device of this kind is provided in DE 199 17 789 A1. The shaped disc is formed by a drive disc which is provided with internal and external protrusions and is scanned by one end of a lever. The other end of the lever is coupled to the lock (that is the locking parts of the closing device such as e.g. the rotary latch and locking pawl) and coordinates the interaction of an operating device such as an inside door handle or outside door handle, with the lock. In the dead-lock state of the closing device, for example, the lock cannot be actuated by either the inside handle or by means of the outside handle. This means that any actuation of the inside door handle or outside door handle is not transferred to the corresponding lock elements, for example, the locking pawl and rotary catch. Conversely, in the unlocked state of the closing device, the door can be opened both by means of the inside handle and by means of the outside handle. The same is true for further locking states, such as the locked or child-lock state, for example.

It would be desirable to provide such a closing device that operates with improved ease.

SUMMARY OF THE INVENTION

The present invention provides a shaped disc through which the closing device can be brought into at least four different locking states, according to one exemplary embodiment. The shaped disc is designed so that it can be brought from any angular position which corresponds to a state different from the unlocked state, for example, the locked state, the dead-lock state or the child-lock state, directly into an angular position which corresponds to the unlocked state without passing through a third locking state.

In one exemplary embodiment, the present invention provides that the individual locking states correspond to specific angular regions on the shaped disc whereby the angular regions are arranged in succession around the circumference of the shaped disc and each angular region of the shaped disc which corresponds to a state other than the unlocked state and is adjoined directly by an angular region which corresponds to the unlocked state.

According to an exemplary embodiment, the present invention provides individual locking states that are not simply arranged one behind the other on the shaped disc but next to each angular region which corresponds to a state other than (i.e., different from) the unlocked state, there is at least one defined angular region which corresponds to the unlocked state. For this purpose several angular regions that correspond to the unlocked state are provided on the shaped disc.

The present invention advantageously provides a very rapid change-over from each locking state which is different from the unlocked state, into the unlocked state. The present invention can be used with particular advantage in the case of so-called keyless-entry or passive-entry systems where the closing device is changed automatically into the unlocked state when a person who has been identified by the system as an authorized user, approaches a vehicle, for example, and actuates the outside door handle thereof. The authorized user can be identified for example by a signal transmitter which the user carries around. With such a closing system, after the authorized user has been identified and actuates the outside door handle, the closing device is brought very rapidly into the unlocked state according to the present invention. In conventional systems, the door would not open immediately when the outside door handle is actuated. Such delay would be seen by the user as a defect or at least as a nuisance. Problems of this kind can arise particularly when the closing device is located in a locking state which is separated from the unlocked state by further locking states, as in conventional systems. The rapid and direct change into the unlocked state which is desirable to overcome these problems, is provided by the present invention.

The closing device of the present invention can be configured in various ways and can be used both in closing systems which have only one lock (e.g. closing device for a single vehicle door) and also in closing systems which are used for actuating several locks, for example, a central locking system in motor vehicles.

According to another exemplary embodiment, the present invention provides a closing device having a drive with which the closing device can be brought into at least three different locking states. The shaped disc is designed so that as the disc is rotated along a predetermined rotary direction, the unlocked state always follows a state which is different from the unlocked state. In other words, there is at least one rotary direction having the property where as the shaped disc rotates along this rotary direction a region corresponding to the unlocked state always follows each region of the shaped disc which has a state different from the unlocked state.

In this case it is ensured that each state which is different from the unlocked state on the shaped disc is adjoined by a region which corresponds to the unlocked state. Furthermore, as the shaped disc rotates along the predetermined rotary direction, a direct change from a state other than the unlocked state, to the unlocked state is possible each time.

The shaped disc according to the invention can be simply formed by a disc-like body which extends in one plane, i.e., a generally planar disc-like body, and the shaped disc can be formed in particular in one piece. As such, the shaped disc can be formed by a cam disc in which outer and/or inner guideways represent the different locking states.

The unlocked state of the closing device preferably corresponds to a locking state in which each lock is unlocked. There is then only one single clearly defined unlocked locking state, namely the state of the closing device in which all locks are unlocked so that the corresponding flaps of the vehicle (e.g. vehicle doors in the case of door locks) can be opened and are not in the dead-lock, child-lock or anti-theft lock state.

The shaped disc interacts with a coupling element which scans the shaped disc and couples an actuating device (e.g. outside handle or inside handle) to the lock or uncouples it from the lock, depending on the angular position of the shaped disc. Only when the relevant actuating device is coupled to the lock can the lock be actuated to open the door.

By using two coupling elements which scan the shaped disc and couple or uncouple the actuating device with or from the lock depending on the angular position of the shaped disc, the locking states which are defined by the shaped disc can be transferred to two different actuating devices such as to an outside door opener and an inside door opener, for example.

According to one exemplary embodiment, two guideways can be provided radially spaced from each other on the shaped disc, each interacting with one of the two coupling elements. In another exemplary embodiment, two coupling elements can scan the same guideway on the shaped disc whereby in this case the two coupling elements are disposed spaced from each other along the circumferential direction of the shaped disc.

The shaped disc itself can be rotated by means of a drive which can be set in motion by actuating a closing cylinder of the lock, remote control (e.g. through a passive-entry system) or by some other closing element.

BRIEF DESCRIPTION OF THE DRAWING

Further features and advantages of the invention will now be explained with reference to the following description of the embodiment shown in the drawings in which.

DETAILED DESCRIPTION

Figure 4:
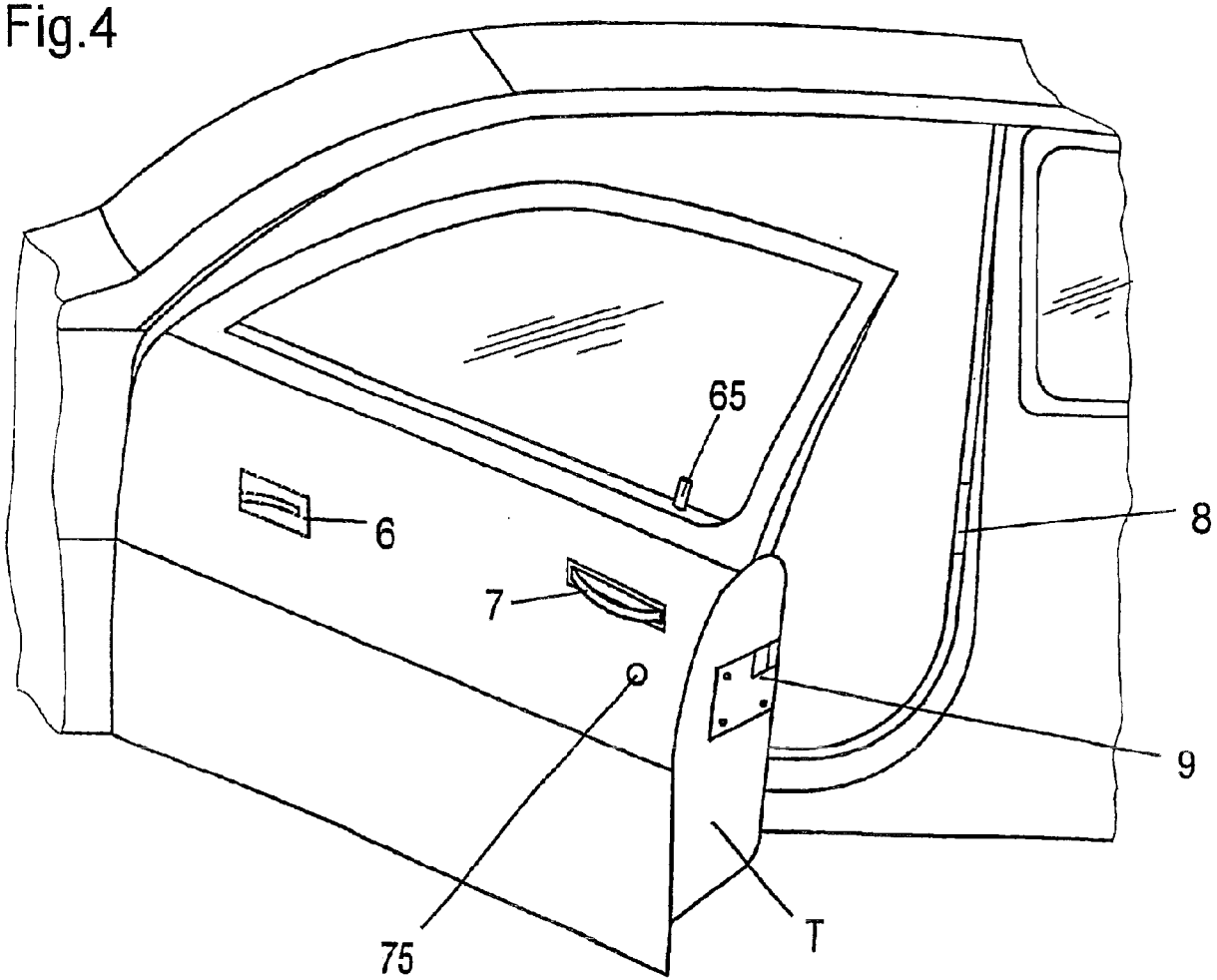
FIG. 4 shows a diagrammatic view of a motor vehicle door.

FIG. 4 shows part of the side of a vehicle body with a door T, including a closing device having a conventional inside door opener in the form of an inside door handle 6, an internal locking button 65, an outside door opener in the form of an outside door handle 7 as well as a closing cylinder 75 and a door lock 9. The door lock 9 corresponds to a holder 8 which is mounted on the side of the body and which engages parts of the door lock 9 to lock the door T.

Figure 5B:
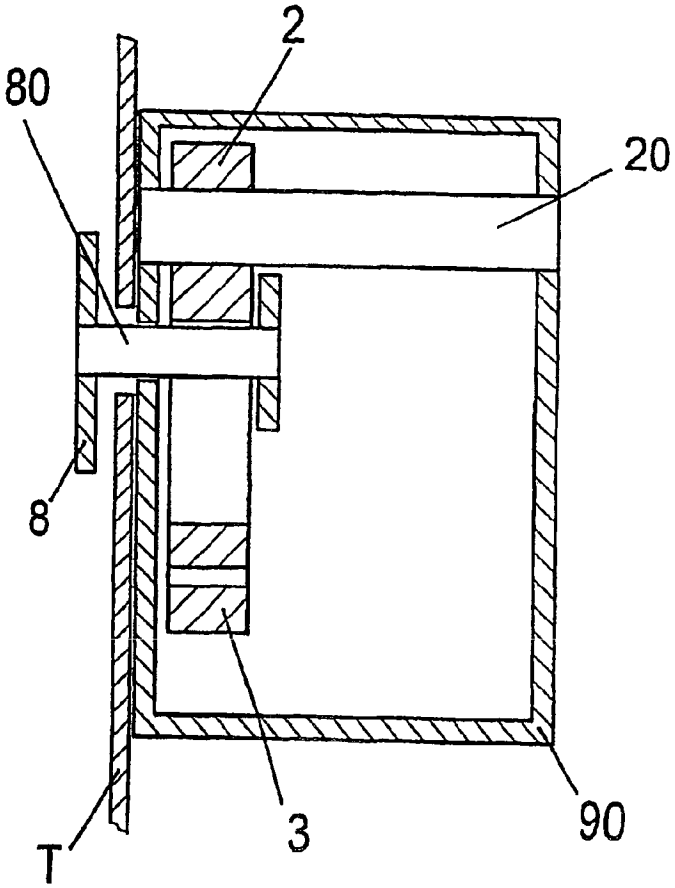
FIGS. 5*a* and 5*b* each show a diagrammatic view of the structure of a door lock.
Figure 5A:
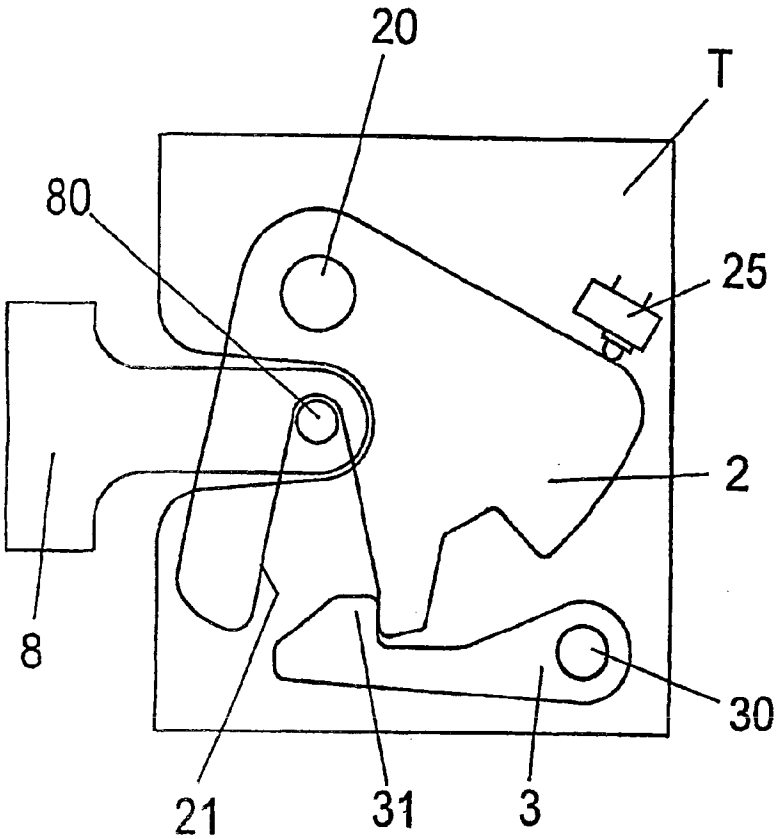

A diagrammatic illustration of a door lock and the associated holder in FIGS. 5*a* and 5*b* shows the lock parts of the door lock, namely a locking pawl 3 with hook 31 capable of swivelling about an axis 30, and a rotary catch 2 which is capable of swivelling about an axis 20 and interacts with the locking pawl 3. Rotary catch 2 includes recess 21 associated with a locking pin 80 of the holder 8. Furthermore a measuring scanner 25 is provided which scans the external contour of the rotary catch 2 to determine the rotary angle thereof. The lock parts 2, 3 (rotary catch and locking pawl) which make up the lock are mounted in a lock housing 90 which is fixed on the door panel.

Other aspects of the above-described exemplary closing device are conventionally known and therefore are not explained further.

One aspect of the present invention is the configuration of a shaped disc by means of which the different locking states of the closing device can be established. The essential locking states are the unlocked state, the locked state, the "child-lock" locking state and the "dead-lock" locking state, but other locking states may be used in other exemplary embodiments. The unlocked state is the locking state in which the lock can be actuated to open the door both by means of the inside door handle and the outside door handle. In the locked state however the outside door handle is uncoupled from the lock so that the door cannot be opened by actuating the outside door handle but may be actuated by the inside door handle. Conversely in the "child-lock" locking state the inside door handle is uncoupled from the lock so that the door cannot be opened by actuating the inside door handle. In the "dead-lock" locking state both the inside door handle and the outside door handle are uncoupled from the door lock so that the door lock cannot be actuated by either the inside door handle nor by the outside door handle to open the door.

With a closing device for controlling several locks, often the rear doors of a vehicle will be in the "child-lock" locking state while the front doors remain in the unlocked state. The child-lock state of the closing device clearly differs from the unlocked state, namely with regard to the state of the locks of the rear doors.

Figure 1A:
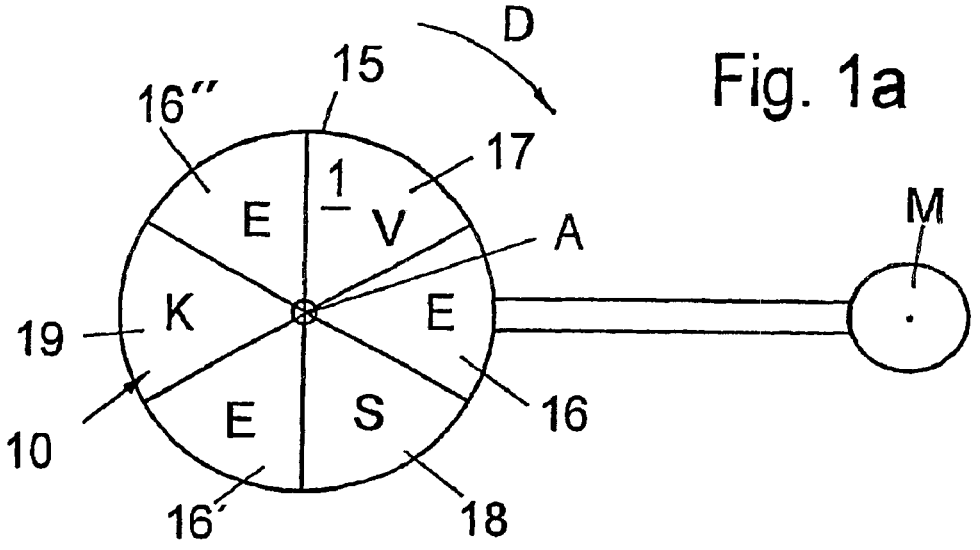
FIG. 1*a* shows diagrammatically a shaped disc which can be driven by a motor and through which four different locking states of one closing device can be defined.

FIG. 1*a* shows diagrammatically a shaped disc 1 with which the locking states listed above can be established. The shaped disc 1 consists of a disc-shaped base body 10 mounted rotatably about an axis A and capable of being rotated by means of a drive M. The drive M can be triggered for example by operating the closing cylinder or by means of remote control in order to change the actual locking state through rotation of the shaped disc 1.

The shaped disc 1 is divided along its circumference into 6 identical sections or angular regions 16, 17, 16", 18, 16' and 19 which are arranged sequentially and adjacent each other around the circumference 15 of the disc-shaped base body 10 and which each cover an angular range of about 60°.

The three sections 16, 16', 16" correspond to the unlocking state E, one section 17 corresponds to the "locked" locking state V, one section 18 corresponds to the "dead-lock" locking state S and section 19 corresponds to the "child-lock" locking state K. The sections or angular regions 16, 17, 16", 19, 16' and 18, respectively, of the shaped disc 1 corresponding to the individual locking states E, V, E, S, E, K are thereby arranged in succession along the circumferential direction, so that as the shaped disc 1 is rotated about its axis A along clockwise direction D, the unlocked state E each time directly follows a locking state K, S, V which is different from the unlocked state E. This also applies when the shaped disc 1 is rotated in the opposite counter-clockwise direction. Each of locking states K, S and V may be referred to as a locking state which is different from the unlocked state, or a locking state other than the unlocked state, throughout the specification. A section corresponding to the unlocked state E is interposed between each of angular regions 17 and 19, angular regions 19 and 18, and angular regions 18 and 17, each of which represent locking states other than the unlocked state.

From FIG. 1*a* it is clear that one section or angular region, for example angular region 16", corresponding to the unlocked state E could be omitted and that nevertheless for each of the sections or angular regions 17, 18, and 19 which respectively represent locking states V, S or K which are different from the unlocked state E, a section or angular region 16, 16' which corresponds to the unlocked state E lies adjacent, i.e., adjoins the locking state other than the unlocked state. In this exemplary embodiment, the direct change from the locking state V (locked) or from the locking state K (child-lock) into the locking state E (unlocked) does not occur in each rotary direction of the shaped disc 1. The direct change from the locking state K (child-lock) into the locking state E (unlocked) would rather be possible only when the shaped disc 1 is rotated clockwise and the direct change from the locking state V (locked) into the locking state E (unlocked) would only be possible when the shaped disc is rotated counter-clockwise.

In the exemplary embodiment in which each of the three sections or angular regions 16, 16', 16" of the shaped disc represent the unlocked state E, it is ensured that with a rotary movement along either rotary direction, the unlocked state E each time directly follows each locking state V, S, K which is different from the unlocked state E.

Figure 1B:
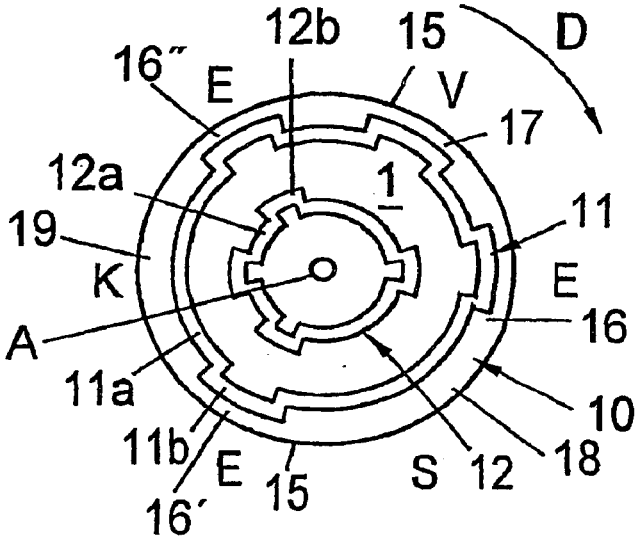
FIG. 1*b* shows a physical, plan view of the embodiment of the shaped disc shown in FIG. 1*a;*

FIG. 1*b* shows an embodiment of a concrete design of the shaped disc 1 shown diagrammatically in FIG. 1*a*. The shaped disc 1 illustrated in FIG. 1*b* has in its disc-shaped base body 10 two radially spaced contours 11, 12 running in the circumferential direction (see circumference 15) of the shaped disc 1. Contours 11, 12 may be alternatively referred to as guideways 11, 12. In one exemplary embodiment, as will be shown in FIG. 2*a*, the guideways 11 and 12 may be grooves formed within the shaped disc. The guideways 11, 12 are each formed by a circumferential guideway section 11*a* and 12*a* respectively which are provided with radially projecting protrusions 11*b*, 12*b* respectively. The protrusions 11*b*, 12*b* are each arranged spaced from each other along the circumferential direction of the corresponding guideway 11, 12 and form a constituent part of the corresponding guideway 11 and 12.

The two guideways 11, 12 of the shaped disc 1 are each scanned by a coupling element as explained further below with reference to FIGS. 2*a* and 2*b*.

A coupling element may be received in one of the guideways 11, 12 and is guided along the corresponding guideway as the shaped disc 1 rotates about its axis. The coupling element is moved outward in a radial direction when it encounters one of the protrusions 11*b*, 12*b* of the corresponding guideway. In one embodiment, when outer guideway 11 is scanned by means of a coupling element, the inside door handle of the closing device is coupled with the lock or uncoupled from the lock when the coupling element detects a protrusion 11*b*. By scanning the inner guideway 12 by means of a further coupling element, the outside door handle is uncoupled from the door lock or coupled with same when the coupling element detects a protrusion 12*b*. A coupling between the corresponding actuating device such as an outside door handle or inside door handle, and the door lock should then exist whenever the associated coupling element detects a protrusion 11*b*, 12*b*.

In this embodiment the unlocked state E is characterised each time by the corresponding angular region 16, 16', 16" of the shaped disc 1 having a protrusion 11*b*, 12*b* within guideways 11 and 12, respectively. In this arrangement in the unlocked state, both the outside door handle and the inside door handle are coupled to the lock so that the door can be opened both by actuating the outside door handle and by actuating the inside door handle.

In the angular region 17 of the shaped disc 1 which represents the locked state V only the outer guideway 11 has a protrusion 11*b*. Correspondingly, the door can only be opened by actuating the inside door handle while opening the door by actuating the outside door handle is not possible.

Conversely in the "child-lock" locking state which is represented by the angular region 19 of the shaped disc 1 only the inner guideway 12 has a protrusion 12*b* so that the door can only be opened by actuating the outside door handle and not however by actuating the inside door handle.

In the section or angular region 18 of the shaped disc 1 which corresponds to the "dead-lock" state, finally neither of the two guideways 11, 12 has a protrusion. Therefore in this state the door lock cannot be actuated to open the door by either the outside door handle or inside door handle.

Figure 1C:
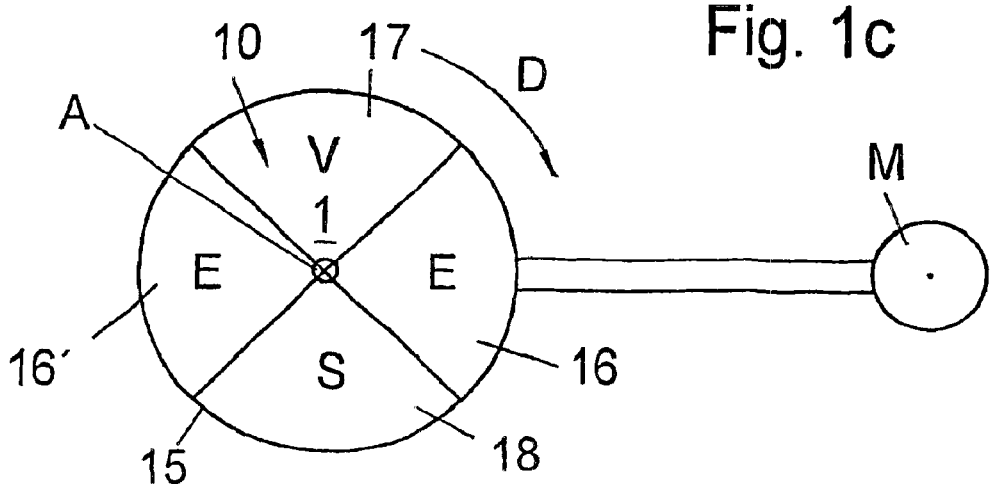
FIG. 1*c* shows a diagrammatic view of a shaped disc which can be rotated by means of a drive and through which three different locking states of a closing device can be defined.
Figure 2A:
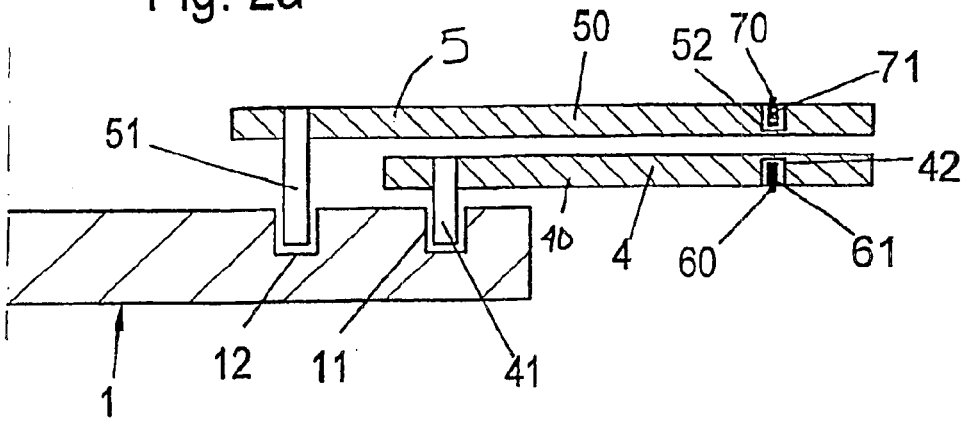
FIG. 2*a* shows a cross-section through a part of an exemplary embodiment of the shaped disc of FIG. 1*b* that has two coupling elements which scan the shaped disc.
Figure 2B:
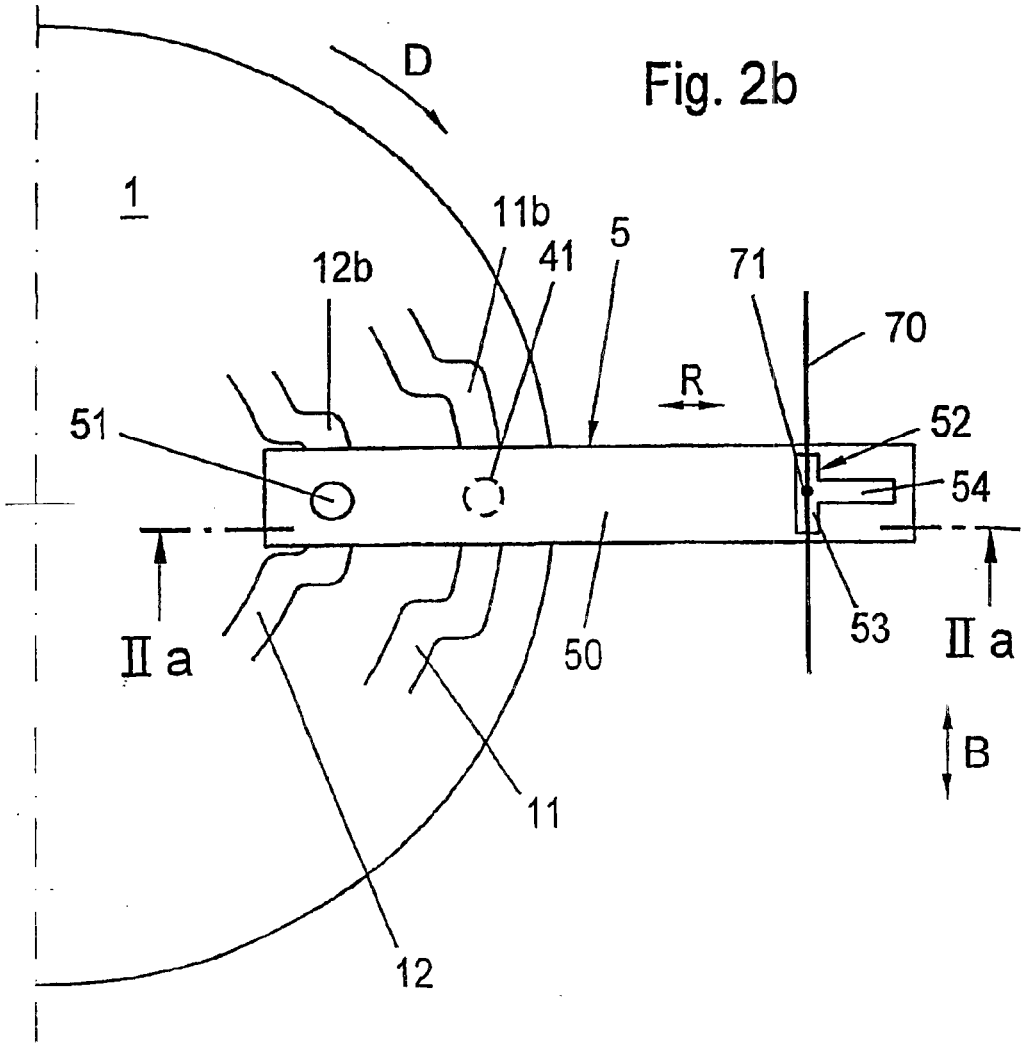
FIG. 2*b* shows a plan view of the shaped disc shown in FIG. 2*a;*

FIGS. 2*a* and 2*b* illustrate an exemplary embodiment in which the shaped disc 1 illustrated in FIG. 1 is scanned by means of two coupling elements 4, 5 whereby the one coupling element 4 scans the outer guideway 11 and the other element 5 scans the inner guideway 12.

Each of the two coupling elements 4, 5 consists of a coupling rod 40, 50 which is mounted radially relative to the shaped disc 1 and which includes at its end facing the shaped disc 1, a pin 41, 51 respectively engaging corresponding guideways 111 and 12. At their respective ends remote from the shaped disc 1, the coupling rods 40, 50 include T-shaped recesses 42 and 52, respectively. T-shaped recess 42 is not visible in FIG. 2*b* as it is hidden below coupling rod 50 and T-shaped recess 52. Connecting members 60, 70 include corresponding pins 61, 71 that run through corresponding recesses 42, 52 across the extension direction of the coupling rods 40, 50. Through the one connecting member 60 the door inside handle is coupled to the door lock and through the other connecting member 70 the outside door handle is coupled to the door lock in this exemplary embodiment. When the inside door handle or outside door handle is actuated for the purpose of opening the door, the control movement is transferred through the corresponding connecting member 60, 70 to the door lock in order to enable the door to be opened through action by the door lock. The corresponding connecting member 60, 70 is moved in an actuating direction B across the extension direction of the coupling rods 40, 50. The extension direction of coupling rods 40, 50 may also be referred to as the longitudinal direction. Actuating direction B is shown to be generally orthogonal to the extension/longitudinal direction.

This movement in the actuating direction is in any case only possible when the pin 61, 71 of the relevant connecting member 60, 70 projects in a section 43, 53 of the recess 42, 52 (see also FIG. 3) which permits movement of the connecting member 60, 70 in the actuating direction B across the extension direction of the coupling rods 40, 50.

The plan view of FIG. 2*b* shows the coupling rod 50 that corresponds to the outside door handle. T-shaped recess 52 includes a first section 53 which permits a movement of the connecting member 70 in the actuating direction B across the extension direction of the coupling rod 50, as well as a second section 54, which does not permit a movement of the connecting member 70 in the actuating direction B. The pin 71 which protrudes from the connecting member 70 down into the recess 52 is blocked as far as movement in the actuating direction B is concerned when it is located in the second section 54 of the recess 52.

FIGS. 2*a* and 2*b* also show that the coupling rods 40, 50 are guided outwards in a radial direction when their pins 41, 51 are located in a protrusion 11*b*, 12*b* of the relevant guideway 11, 12. In this state which is shown in the exemplary embodiment of FIG. 2*b*, the coupling rod 50 is associated with the outside door handle, and pin 71 of associated connecting member 70 engages section 53 of the recess 52 which enables the connecting member 70 to move into the actuating direction B. Then the outside door handle is coupled through the connecting member 70 to the lock so that the door can be opened by actuating the outside door handle.

With respect to the exemplary state shown in FIGS. 2*a* and 2*b*, the same applies for the inside door handle since the pin 41 of coupling rod 40 associated with the inside door handle also engages a protrusion 11*b* of the associated guideway 11 on the shaped disc 1 and influences the position of pin 61 of connecting member 60.

If now by rotating the shaped disc 1 along the rotary direction D the pin 41, 51 of one of the coupling elements 4, 5 is guided into a section of the associated guideway 11, 12 which forms no protrusion, then the corresponding pin 61, 71 of the associated connecting member 60, 70 respectively engages in a section 44, 54 of the relevant recess 42, 52 which blocks movement of the connecting member in the actuating direction B. The corresponding actuating device (inside door handle or outside door handle) is then uncoupled from the door lock so that the door cannot be opened by actuating the said actuating device.

Figure 3:
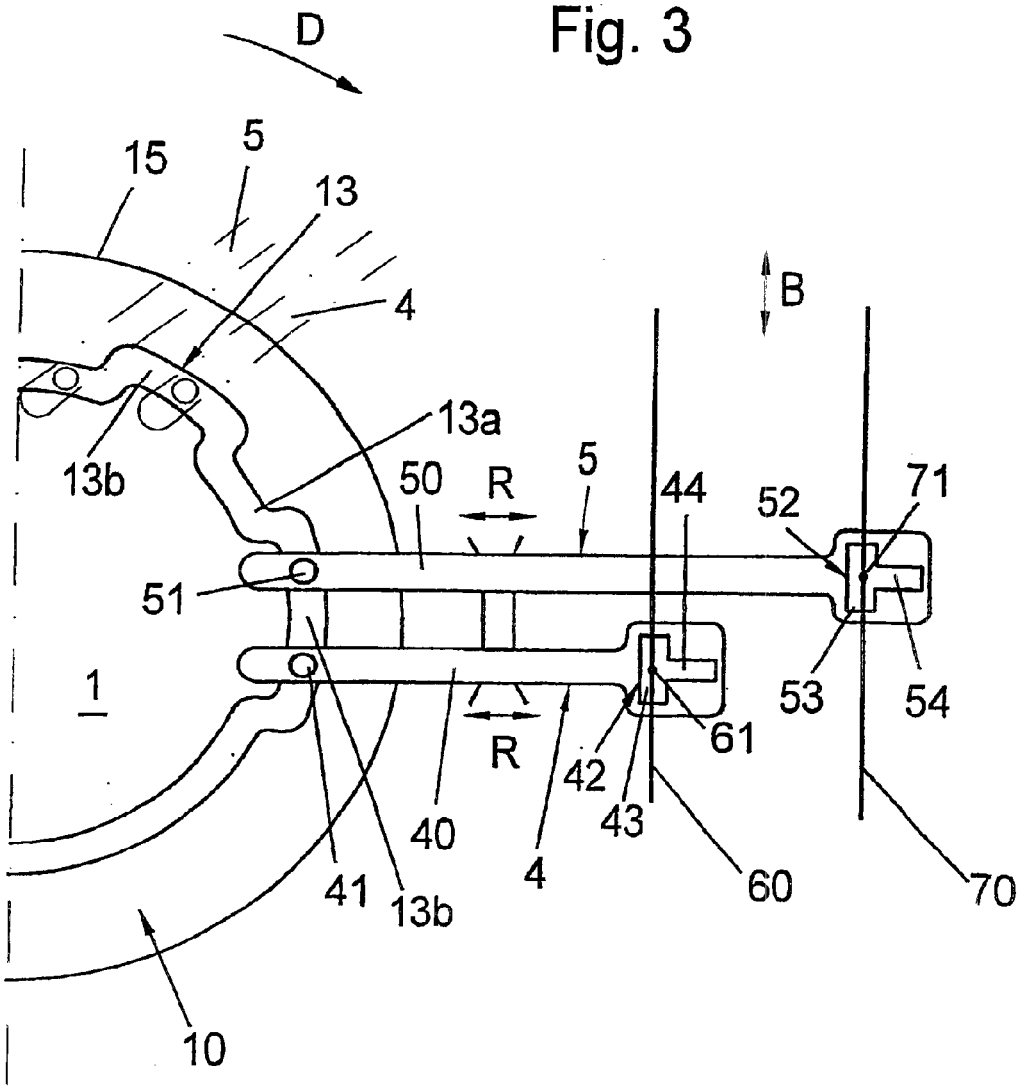
FIG. 3 shows a plan view of another exemplary embodiment of the shaped disc having two coupling elements that scan the shaped disc.

FIG. 3 shows a plan view of another exemplary embodiment of the shaped disc 1 shown diagrammatically in FIG. 1*a* This exemplary embodiment is a modification of the embodiment illustrated in FIGS. 1*b*, 2*a* and 2*b*. Therefore only the differences between the embodiments will be explained below. Like reference numerals represent like features as described above.

In the exemplary embodiment of a shaped disc 1 illustrated in FIG. 3, only one guideway 13 is provided in its disc-shaped base body 10 which consists of a circumferential guideway section 13*a* which has a number of circumferentially spaced out radially outwardly projecting protrusions 13*b*.

Two coupling elements 4, 5 are set spaced out along the circumference 15 of the shaped disc 1 and each engage guideway 13 by a pin 41 and 51 respectively. The two coupling elements 4, 5 thereby scan different regions of the guideway 13 at any given time.

In the state shown in FIG. 3, pins 41, 51 of the two coupling elements 4, 5 engage a protrusion 13*b* of the guideway 13. The closing device is therefore located in the unlocked state in which the lock can be actuated both by means of the inside door opener and outside door opener for the purpose of opening the door. This can be seen in FIG. 3 whereby corresponding pins 61 and 71 of both connecting members 60, 70 each engage a section 43, 53 of the associated T-shaped recesses 42, 52 of a coupling rod 40, 50 such that movement of the relevant connecting member 60, 70 in the actuating direction B is possible.

If the shaped disc 1 is rotated sufficiently clockwise in the rotary direction D such that the two coupling elements 4, 5 engage in the guideway 13 of the shaped disc 1 in the manner shown by dotted lines in FIG. 3, then another situation arises regarding the coupling of the actuating devices of the closing device with the door lock. For reasons of clarity, the illustration of FIG. 3 shows the position of the two coupling elements 4, 5 rotated counter-clockwise relative to the shaped disc 1. In practice, the shaped disc 1 may be rotated clockwise with respect to the two coupling elements 4, 5 which remain spatially unchanged. The locking states, however, are determined by the position of the shaped disc 1 relative to the coupling elements 4, 5 as represented in FIG. 3.

In the state illustrated by dotted lines in FIG. 3 a coupling element 4 engages in a section 13*a* of the guideway 13 which forms no protrusion and the other coupling element 5 engages in a section 13*b* of the guideway 13 which forms a radial protrusion. One of the actuating devices is therefore uncoupled from the door lock while the door lock can be actuated with the other actuating device for the purpose of opening the door.

Since in the state indicated by dotted lines in FIG. 3 only the coupling element 5 assigned to the outside door opener engages in a protrusion 13*b* of the guideway 13, in this state the door can only be opened by actuating the outside door handle. This then represents the "child-lock" locking state.

FIG. 1*c* shows diagrammatically another exemplary embodiment of a shaped disc 1 with which only three different locking states can be fixed, namely for example the unlocked state E, the locked state V and the "dead-lock" locking state S. Each of these states E, V, S corresponds to a section or angular region 16, 16', 17, 18 of the shaped disc 1. In particular, angular regions 16, 17, 16' and 15 correspond to locking states E, V, E and S, respectively. Thus for the unlocked state E two sections or angular regions 16, 16' are provided so that in one rotary direction D of the shaped disc 1 every other section or angular region is assigned to the unlocked state E. It is hereby ensured that as the shaped disc 1 is rotated in the rotary direction D the unlocked state E always directly follows each locking state V, S which is different from the unlocked state E. The same is true for rotation in the opposite rotary direction. Drive M is coupled to the shaped disc 1 and provides for rotating the shaped disc 1.

What is claimed is:

1. A closing device for a vehicle comprising:

at least one lock;

a drive fixing a plurality of locking states of the closing device and with which the closing device can be brought into at least four different locking states; and a rotatably mounted shaped disc which can be rotated by the drive to individual locking states of the plurality of locking states corresponding to specific angular positions of the shaped disc, the shaped disc designed so that it can be brought from each angular position which corresponds to a locking state which is different from an unlocked state, directly into a respective angular position of the angular positions, each respective angular position corresponding to the unlocked state of the closing device, wherein each of the individual locking states of the closing device corresponds to a specific angular region on the shaped disc, the angular regions arranged in succession along a circumferential direction of the shaped disc, and wherein each angular region of the shaped disc associated with a locking state which is different from the unlocked state, is directly adjoined by an angular region associated with the unlocked state.

2. A closing device for a vehicle comprising:

at least one lock;

a drive fixing a plurality of locking states of the closing device and with which the closing device can be brought into at least three different locking states; and a rotatably mounted shaped disc which can be rotated by the drive to individual locking states of the plurality of locking states corresponding to specific angular positions of the shaped disc;

the shaped disc formed so that when the shaped disc is rotated along a rotary direction, an unlocked state always follows a locking state of the closing device which is different from the unlocked state, wherein each of the individual locking states of the closing device corresponds to a specific angular region on the shaped disc, the angular regions arranged in succession along a circumferential direction of the shaped disc, and wherein each angular region of the shaped disc associated with a locking state which is different from the unlocked state, is directly adjoined by an angular region associated with the unlocked state.

3. The closing device according to claim 1 or 2, wherein each angular region associated with a locking state which is different from the unlocked state, is adjoined directly by an angular region associated with the unlocked state along a predetermined direction along the circumference of the shaped disc.

4. The closing device according to claim 3, wherein each angular region of the shaped disc associated with a locking state which is different from the unlocked state, is interposed directly between two angular regions that are each associated with the unlocked state.

5. The closing device according to claim 1 or 2, wherein the shaped disc is formed of a generally planar disc-like body.

6. The closing device according to claim 1 or 2, wherein the shaped disc is formed of a cam disc.

7. The closing device according to claim 1 or 2, wherein, in the unlocked state of the closing device, each lock of the closing device is unlocked.

8. The closing device according to claim 1 or 2, wherein the shaped disc interacts with a coupling element which scans the shaped disc and couples an actuating device to the lock or uncouples the actuating device from the lock, depending on the angular position of the shaped disc.

9. The closing device according to claim 1 or 2, wherein the closing device is associated with two different actuating devices.

10. The closing device according to claim 9, wherein the shaped disc interacts with two coupling elements which scan the shaped disc and which each couple one of the actuating devices to the lock or uncouple one of the actuating devices from the lock depending on the angular position of the shaped disc.

11. The closing device according to claim 10, wherein the disc includes two radially spaced guideways, each guideway interacting with one of the coupling elements.

12. The closing device according to claim 10, wherein the disc includes a guideway and the two coupling elements engage the guideway and are spaced from each other along the circumference of the shaped disc.

13. The closing device according to claim 1 or 2, wherein the closing device has at least one of a locked locking state, a child lock locking state and a dead-lock locking state.

14. The closing device according to claim 1 or 2, wherein the shaped disc is rotatable by means of a drive which can be set in operation by actuating a closing cylinder or a remote control of the closing device.

15. The closing device according to claim 14, wherein the drive can be set in operation by a passive-entry mechanism.

16. The closing device according to claim 1 or 2, wherein the closing device comprises at least two locks and in the unlocked state of the closing device, each of the locks is unlocked.

17. The closing device according to claim 16, wherein each of the at least two locks corresponds to no more than one shaped disc for establishing the relevant locking state of the closing device.

18. A vehicle door with a closing device according to claim 1 or 2.

19. The closing device according to claim 9, wherein the two different actuating devices comprise an outside door opener and an inside door opener, each of which is in active connection with the lock through the drive.

20. A closing device for a vehicle comprising:

at least one lock;

a drive fixing a plurality of locking states of the closing device and with which the closing device can be brought into at least four different locking states; and a rotatably mounted shaped disc which can be rotated by the drive to individual locking states of the plurality of locking states corresponding to specific angular positions of the shaped disc, the shaped disc designed so: that it can be, brought from each angular position which corresponds to a locking state which is different from an unlocked state, directly into a respective angular position of the angular positions, each respective angular position corresponding to the unlocked state of the closing device, wherein the closing device is associated with two different actuating devices, wherein the shaped disc interacts with two coupling elements which scan the shaped disc and which each couple one of the actuating devices to the lock or uncouple one of the actuating devices from the lock depending on the angular position of the shaped disc, and wherein the disc includes two radially spaced guideways, each guideway interacting with one of the coupling elements.

21. A closing device for a vehicle comprising:

at least one lock;

a drive fixing a plurality of locking states of the closing device and with which the closing device can be brought into at least four different locking states; and a rotatably mounted shaped disc which can be rotated by the drive to individual locking states of the plurality of locking states corresponding to specific angular positions of the shaped disc, the shaped disc designed so that it can be brought from each angular position which corresponds to a locking state which is different from an unlocked state, directly into a respective angular position of the angular positions, each respective angular position corresponding to the unlocked state of the closing device, wherein the closing device is associated with two different actuating devices, wherein the shaped disc interacts with two coupling elements which scan the shaped disc and which each couple one of the actuating devices to the lock or uncouple one of the actuating devices from the lock depending on the angular position of the shaped disc, and wherein the disc includes a guideway and the two coupling elements engage the guideway and are spaced from each other along the circumference of the shaped disc.

22. A closing device for a vehicle comprising:

at least one lock;

a drive fixing a plurality of locking states of the closing device and with which the closing device can be brought into at least three different locking states; and a rotatably mounted shaped disc which can be rotated by the drive to individual locking states of the plurality of locking states corresponding to specific angular positions of the shaped disc;

the shaped disc formed so that when the shaped disc is rotated along a rotary direction, an unlocked state always follows a locking state of the closing device which is different from the unlocked state, wherein the closing device is associated with two different actuating devices, wherein the shaped disc interacts with two coupling elements which scan the shaped disc and which each couple one of the actuating devices to the lock or uncouple one of the actuating devices from the lock depending on the angular position of the shaped disc, and wherein the disc includes two radially spaced guideways, each guideway interacting with one of the coupling elements.

23. A closing device for a vehicle comprising:

at least one lock;

a drive fixing a plurality of locking states of the closing device and with which the closing device can be brought into at least three different locking states; and a rotatably mounted shaped, disc which can be rotated by the drive to individual locking states of the plurality of locking states corresponding to specific angular positions of the shaped disc;

the shaped disc formed so that when the shaped disc is rotated along a rotary direction, an unlocked state always follows a locking state of the closing device which is different from the unlocked state, wherein the closing device is associated with two different actuating devices, wherein the shaped disc interacts with two coupling elements which scan the shaped disc and which each couple one of the actuating devices to the lock or uncouple one of the actuating devices from the lock depending on the angular position of the shaped disc, and wherein the disc includes a guideway and the two coupling elements engage the guideway and are spaced from each other along the circumference of the shaped disc.

24. A closing device according to claim 1, 20, or 21, wherein the shaped disc is rotatable along a first rotary direction from each angular position corresponding to a locking state of said plurality of locking states, which is different from the unlocked state, directly to a position corresponding to the unlocked state, and wherein the shaped disc is rotatable along a second rotary direction opposite the first rotary direction from each angular position corresponding to a locking state of said plurality of locking states, which is different from the unlocked state, directly to a position corresponding to the unlocked state.

25. A closing device according to claim 2, 22 or 23 wherein the shaped disc is rotatable along a first rotary direction to the individual locking states of the plurality of locking states and wherein the shaped disc is rotatable along a second rotary direction opposite the first rotary direction to the individual locking states of the plurality of locking states.

26. A closing device according to claim 1, 2, 20, 21, 22 or 23 wherein each angular position of the shaped disc corresponding to a locking state is adjoined on opposite sides with angular positions corresponding to an unlocked state.

* * * * *